US011738827B2

(12) United States Patent
Wessman

(10) Patent No.: US 11,738,827 B2
(45) Date of Patent: Aug. 29, 2023

(54) HYDROFOIL SYSTEM AND MARINE VESSEL

(71) Applicant: VOLVO PENTA CORPORATION, Gothenburg (SE)

(72) Inventor: Björn Wessman, Torslanda (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 2 days.

(21) Appl. No.: 17/597,874

(22) PCT Filed: Aug. 19, 2019

(86) PCT No.: PCT/EP2019/072138
§ 371 (c)(1),
(2) Date: Jan. 27, 2022

(87) PCT Pub. No.: WO2021/032277
PCT Pub. Date: Feb. 25, 2021

(65) Prior Publication Data

US 2022/0250716 A1 Aug. 11, 2022

(51) Int. Cl.
*B63B 1/30* (2006.01)
*B63B 1/26* (2006.01)
(Continued)

(52) U.S. Cl.
CPC ..... *B63B 1/30* (2013.01); *B63B 1/26* (2013.01); *B63B 2001/202* (2013.01); *B63B 2001/281* (2013.01)

(58) Field of Classification Search
CPC .. B63B 1/30; B63B 1/244; B63B 1/28; B63B 1/26; B63B 2001/202; B63B 1/20; B63B 2001/281; B63B 1/285; B63H 20/106
(Continued)

(56) References Cited

U.S. PATENT DOCUMENTS 2,984,197 A 5/1961 Bader
3,164,117 A 1/1965 Lopez
(Continued)

FOREIGN PATENT DOCUMENTS

CN 101712372 B 4/2012
EP 0240472 B1 1/1993
RU 2059513 C1 5/1996

OTHER PUBLICATIONS

International Search Report and Written Opinion dated Apr. 20, 2020 in corresponding International PCT Application No. PCT/EP2019/072138, 10 pages.

*Primary Examiner* — Daniel V Venne
(74) *Attorney, Agent, or Firm* — Venable LLP; Jeffri A. Kaminski

(57) ABSTRACT

The invention relates to a hydrofoil system for a marine vessel comprising a hull (101), the hydrofoil system comprising at least one pair of foldable hydrofoils (109, 110) which are pivoted relative to the marine vessel, wherein each hydrofoil (109, 110) is controllable by at least one actuator (930) for displacement of the at least one pair of foldable hydrofoils in a lateral direction of the marine vessel between a stowed position and a deployed position. Each foldable hydrofoil (109, 110) is hinged relative to the hull above the water line on opposite sides of the marine vessel. A first portion (111) of each hydrofoil extends adjacent the hull (101) towards the water line of the marine vessel when the hydrofoil is in the stowed position and a second portion (112) comprises a free second end extending under the hull. The second portion (112) is submerged and arranged in a lateral recess (107) behind a stepped hull portion (106) of the marine vessel when the hydrofoil is in the stowed position.

17 Claims, 8 Drawing Sheets

(51) Int. Cl.
*B63B 1/20* (2006.01)
*B63B 1/28* (2006.01)

(58) Field of Classification Search
USPC ..... 114/274, 278, 280, 282
See application file for complete search history.

(56) References Cited

U.S. PATENT DOCUMENTS 3,802,369 A * 4/1974 Ishimoto ..... B63B 34/10
440/42
4,335,671 A 6/1982 Warner et al.
6,167,829 B1 * 1/2001 Lang ..... B63B 1/38
114/61.12
6,439,148 B1 * 8/2002 Lang ..... B63B 1/288
114/61.12
6,782,839 B1 8/2004 Nozaki

* cited by examiner

HYDROFOIL SYSTEM AND MARINE VESSEL

CROSS-REFERENCE TO RELATED APPLICATIONS

This application is a U.S. National Stage application of PCT/EP2019/072138, filed Aug. 19, 2019 and published on Feb. 25, 2021, as WO 2021/032277 A1, all of which is hereby incorporated by reference in its entirety.

TECHNICAL FIELD

The present invention relates to a foldable hydrofoil system and a marine vessel with such a system.

BACKGROUND

Known hydrofoil boats are usually provided with at least one hydrofoil consisting of a wing like structure mounted on struts below the hull, or across the keels of a catamaran in a variety of boats. A hydrofoil operates in the same way as a wing-shaped airfoil to create a lifting force and can have a similar cross-section. As a hydrofoil-equipped watercraft increases in speed, the hydrofoil elements below the hull develop enough lift to raise the hull out of the water, which greatly reduces hull drag. This provides a corresponding increase in speed and fuel efficiency, as less propulsive force is required to drive the vessel.

When used as a lifting element on a hydrofoil boat, the upward force exerted by the hydrofoil lifts the body of the vessel clear of the water, thereby decreasing drag of the hull and increasing the speed of the vessel. The lifting force eventually balances with the weight of the craft, reaching a point where the hydrofoil no longer lifts out of the water but remains in equilibrium. Since wave resistance and other impeding forces such as various types of drag on the hull are eliminated as the hull lifts clear, turbulence and drag act increasingly on the much smaller surface area of the hydrofoil, and decreasingly on the relative larger area of the hull, creating a marked increase in speed. In the case of fixed hydrofoils, the lifting force will be dependent on the speed of the vessel. Alternatively, hydrofoils can be provided with control surfaces in the same way as an aircraft wing, whereby the control surfaces can be angled to increase or decrease the lifting force. Once the hull is lifted clear of the water, the effect of the reduced drag can be used for increased speed, while maintaining the output of the propulsion system. Alternatively, the reduced drag can be used for increased fuel economy, while reducing the output of the propulsion system to a lower level once the hull is lifted clear of the water.

U.S. Pat. No. 4,335,671 discloses a vessel comprising fixed hydrofoils. A problem with this solution is the increased draft created by the hydrofoils which makes it impossible for these vessels to navigate in shallow waters. A further problem is the increased drag experienced by fixed hydrofoil vessels when travelling at speeds where the hull is in contact with the water.

Various solutions have been suggested to overcome the above problems relating to drag and draft. U.S. Pat. No. 2,984,197 discloses a vessel comprising hydrofoils which are retractable into contact with the hull of the vessel. A problem with this solution is that the retracted hydrofoils extend outside the envelope of the submerged hull when the hydrofoils are stowed. Compared to fixed hydrofoil vessels, the draft is reduced but the drag created by the retracted hydrofoils at low speed is still substantial.

The invention provides an improved hydrofoil system aiming to solve the above-mentioned problems.

SUMMARY

An object of the invention is to provide a foldable hydrofoil system for a vessel, which system solves the above-mentioned problems.

The object is achieved by hydrofoil system and a marine vessel comprising such a hydrofoil system according to the appended claims.

In the subsequent text, the term "water line" is defined as the level around the hull reached by the surrounding water when the vessel is at rest. The term "longitudinal axis" is defined as an axis extending between the bow and the stern of the vessel in line with the keel. With respect to the foldable hydrofoils, the term "stowed position" refers to a position where the hydrofoils are inoperative and fully retracted. Similarly, the term "deployed position" refers to a position where the hydrofoils are operative and fully deployed. The subsequent text also refers to a "stepped hull". A stepped hull can comprise one or more steps and is a known design feature on the hull bottom of a planing hull of high speed marine vessels. Said step or steps are breaks in the hull intended to reduce the amount of hull surface in contact with the water, i.e. the wetted hull surface. Steps can run straight across the hull or can be V-shaped, with the vertex facing forward or aft. They usually have large apertures on the outboard side of the hull to allow air to be sucked down below the hull into the step in order to ventilate the step.

According to a first aspect of the invention, the invention relates to a hydrofoil system for a marine vessel comprising a hull. The hydrofoil system comprises at least one pair of foldable hydrofoils which are pivoted relative to the hull of the marine vessel, wherein each hydrofoil is controllable by at least one actuator for displacement of the at least one pair of foldable hydrofoils in a lateral direction of the marine vessel between a stowed position and a fully deployed or operative position. In this context, the term "lateral direction" is defined to include a transverse direction relative to the central longitudinal axis of the marine vessel, i.e. at right angles to said longitudinal axis, as well as a substantially transverse direction. A substantially transverse direction intersects the longitudinal axis of the vessel and can be angled up to about 5° rearwards from the transverse direction.

Each foldable hydrofoil comprises a first portion comprising an upper end mounted hinged relative to the hull above the water line on opposite sides of the marine vessel relative to each other. Further, each first portion extends adjacent the hull between the upper end and the water line of the marine vessel when the hydrofoil is in the stowed position. Each foldable hydrofoil comprises a second portion comprising a free second end extending under the hull and under the water line of the marine vessel when the hydrofoil is in the stowed position. The submerged second portion of the respective hydrofoil is arranged in a lateral recess behind a stepped hull portion of the marine vessel when the hydrofoil is in the stowed position.

According to the invention, at least the submerged portions of the hydrofoils are located in the lateral recess behind the stepped hull portion of the marine vessel when the hydrofoils are in the stowed position. Hence, if the stepped portion extends above the waterline when the vessel is stationary, at least a lower part of the first portion can be located in the lateral recess behind the stepped hull portion.

A lower outer surface of each hydrofoil is at least flush with the submerged outer surface of the hull in front of the stepped hull portion when the hydrofoil is in the stowed position. In this context, an outer surface of the hydrofoil faces away from the outer surface of the hull. By locating the stowed hydrofoils so that their outer surfaces are flush with or inside the envelope of the outer hull surface immediately in front of the step in the hull, it is possible to virtually eliminate any drag from the stowed hydrofoils when the vessel is travelling at low or planing speeds. In order to reduce drag as well as air resistance, an outer side surface of each hydrofoil can be located in a recess in the side of the hull above the water line when the hydrofoil is in the stowed position. The recesses in the opposite sides of the hull can form a continuation of the submerged stepped hull portion. In the latter case, both the first and the second portions of the hull can be located in a step or a recess in the hull.

Each hydrofoil comprises a single structural component having a generally angled wing shape. The shape of the hydrofoil conforms to the outer surface of the hull at least below and preferably also above the water line. In this way at least the submerged portion of the hydrofoil conforms with and is located at least flush with the outer surface of an adjacent portion of the hull. This is achieved by giving the outer surface of each hydrofoil the same cross-sectional shape as the outer surface of the hull immediately in front of the respective stowed hydrofoil. In this example, the cross-sections are taken at right angles to the longitudinal axis of the vessel.

The first end of each foldable hydrofoil comprises a hinge having parallel or near parallel pivot axes extending in the longitudinal direction of the marine vessel, in a plan view of the vessel. The hinges allow the hydrofoils to be pivoted away from the hull of the vessel, so that they can provide a lifting force sufficient to lift the hull clear of the water. Simultaneously, one or more drive units for propelling the vessel are extended downwards to allow the drive units to remain submerged as the hull of the vessel is lifted out of the water by the hydrofoils with increasing speed.

The second end of the hydrofoils extends at least up to the central longitudinal axis of the marine vessel when the hydrofoils are in their stowed positions. Hydrofoils according to this example can be suited for smaller and/or relatively light vessels, requiring a correspondingly smaller lifting force to make the hull clear the surface of the water.

Preferably, the second ends of each pair of hydrofoils are arranged to extend a predetermined distance past the central longitudinal axis of the marine vessel. Hydrofoils according to this example are suited for larger and/or relatively heavy vessels, requiring a correspondingly larger lifting force to make the hull clear the surface of the water. According to one example, the second ends of each pair of hydrofoils are arranged to overlap below the keel of the vessel when the hydrofoils are in the stowed position. When the hydrofoils overlap in the lateral direction of the vessel, the recessed portion of the stepped hull should have a recessed depth sufficient for accommodating the second ends of the hydrofoils in the stowed position. Alternatively, or in combination, the thickness of the overlapping hydrofoils sections can be selected to fit in the stepped hull portion. During deployment, the overlapping hydrofoils are arranged to be displaced sequentially when moved towards their operative positions, wherein the outermost hydrofoil is actuated first. During retraction of the hydrofoils towards the stowed position the hydrofoils are actuated in reverse, wherein the innermost hydrofoil is actuated first.

When the hydrofoils are arranged to overlap below the keel of the vessel the first end of both foldable hydrofoils comprise a hinge having a pivot axis extending in the horizontal plane in the longitudinal direction of the marine vessel. In this way the hydrofoils are deployed symmetrically in the lateral direction and do not cause a moment about the center of gravity of the vessel requiring a steering correction.

According to a further example, the second ends of each pair of hydrofoils are arranged to extend side-by-side adjacent the hull, in the longitudinal direction thereof, when the hydrofoils are in the stowed position. As the hydrofoils do not overlap in the lateral direction of the vessel, the recessed portion of the stepped hull requires a relatively small recessed depth for accommodating the second ends of the hydrofoils in the stowed position. This arrangement can allow the use of a standard hull as the stepped hull portion provided has a sufficient recessed depth for the longitudinally offset hydrofoils. During deployment, the overlapping hydrofoils are arranged to be displaced simultaneously when moved towards the fully deployed, operative position, as the hydrofoils do not interfere with each other during the displacement. When retracting the hydrofoils towards the stowed position the hydrofoils are simply actuated in reverse.

In the example where the stowed hydrofoils are side-by-side adjacent the hull, the first ends of both foldable hydrofoils can comprise a hinge having a pivot axis extending in the horizontal plane in the longitudinal direction of the marine vessel. When these hydrofoils are deployed, the submerged second ends of each hydrofoil will be offset in the longitudinal direction of the vessel when each hydrofoil reaches its operative position. As the hydrofoils are deployed non-symmetrically, or offset in the lateral direction, a moment is generated about the center of gravity of the vessel. This moment will require a steering correction in order to maintain the vessel on a straight heading.

Alternatively, the first end of one of the hydrofoils in a side-by-side arrangement can comprise one of the hinges having a pivot axis extending at an angle to the horizontal plane in the longitudinal direction of the marine vessel. When the hydrofoils are deployed, the offset between the submerged second ends of each hydrofoil in the longitudinal direction of the vessel can be reduced or eliminated when each hydrofoil reaches its operative position. Consequently, the generated moment requiring a steering correction in order to maintain the vessel on a straight heading can be reduced or eliminated. This arrangement will require a corresponding angle between the first and second portions of the hydrofoil with the angled hinge, in order to place its submerged second portion in a substantially horizontal position for generating a sufficient lifting force. The angled transition between the first and second portions can be in the shape of a distinct line or a twisted curve, depending on the cross-sectional shape of the hull.

According to a further alternative, the first end of one of the hydrofoils in a side-by-side arrangement can comprise hinges having pivot axis extending at an angles placed in equal and opposite directions relative to the horizontal plane in the longitudinal direction of the marine vessel.

According to a further alternative, the first ends of both foldable hydrofoils can comprise a hinge having a pivot axis extending in the horizontal plane in the longitudinal direction of the marine vessel. As the hydrofoils are deployed, the offset between the submerged second ends of each hydrofoil in the longitudinal direction of the vessel can be reduced or eliminated by displacing one or both hydrofoils in the longitudinal direction of the vessel. When the hydrofoils reach their operative positions, both hydrofoils can be arranged symmetrically in the lateral direction and do not cause a moment about the center of gravity of the vessel requiring a steering correction.

Independently of the angle of the hinge supporting each hydrofoil, at least the first portion of each hydrofoil can extend downwards at right angles to the water line when the hydrofoil is in the stowed position. Alternatively, at least the first portion can extend at a predetermined angle to the water line, in a downward and rearward direction, when the hydrofoil is in the stowed position. The angle of the first portion of the hydrofoil can be selected to conform to the cross-sectional shape of stepped hull portion, above and/or below the water line.

The hydrofoil system according to the invention can be operated between the stowed and operative positions by means of one or more electric or hydraulic actuators. Each hydrofoil can be connected to at least one actuator arranged within the hull of the marine vessel, which actuator is arranged to displace the hydrofoils between their stowed and fully deployed positions. The size and number of actuators is dependent on the force required to deploy and maintain the hydrofoils in their operative positions. Consequently, the hydrofoils can be operated by a single, common actuator, or by one or more actuators for each hydrofoil. According to one example, the at least one actuator is arranged below the water line within the hull of the marine vessel.

According to a second aspect of the invention, the invention relates to a marine vessel that is provided with a hydrofoil system as described above.

The arrangement according to the invention solves the problem of increased draft as encounter by vessels comprising fixed hydrofoils, which makes it impossible for these vessels to access shallow ports or to navigate rivers. The invention also solves the problem of increased drag experienced by fixed hydrofoil vessels when travelling at speeds where the hull is in contact with the water.

With respect to vessels with folding hydrofoils, the invention solves the problem of increased draft experienced by folding hydrofoil vessels when travelling at speeds where the hull is in contact with the water. Known vessels of this type are provided with hydrofoils which either extend outside the envelope of the submerged hull or protrude above or inside the upper portions of the hull when the hydrofoils are stowed and not in use. The solution according to the invention provides a compact arrangement that does not create undesired drag or require excessive space for the stowed hydrofoils, while also providing a lifting force sufficient for lifting the vessel out of the water when fully deployed.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
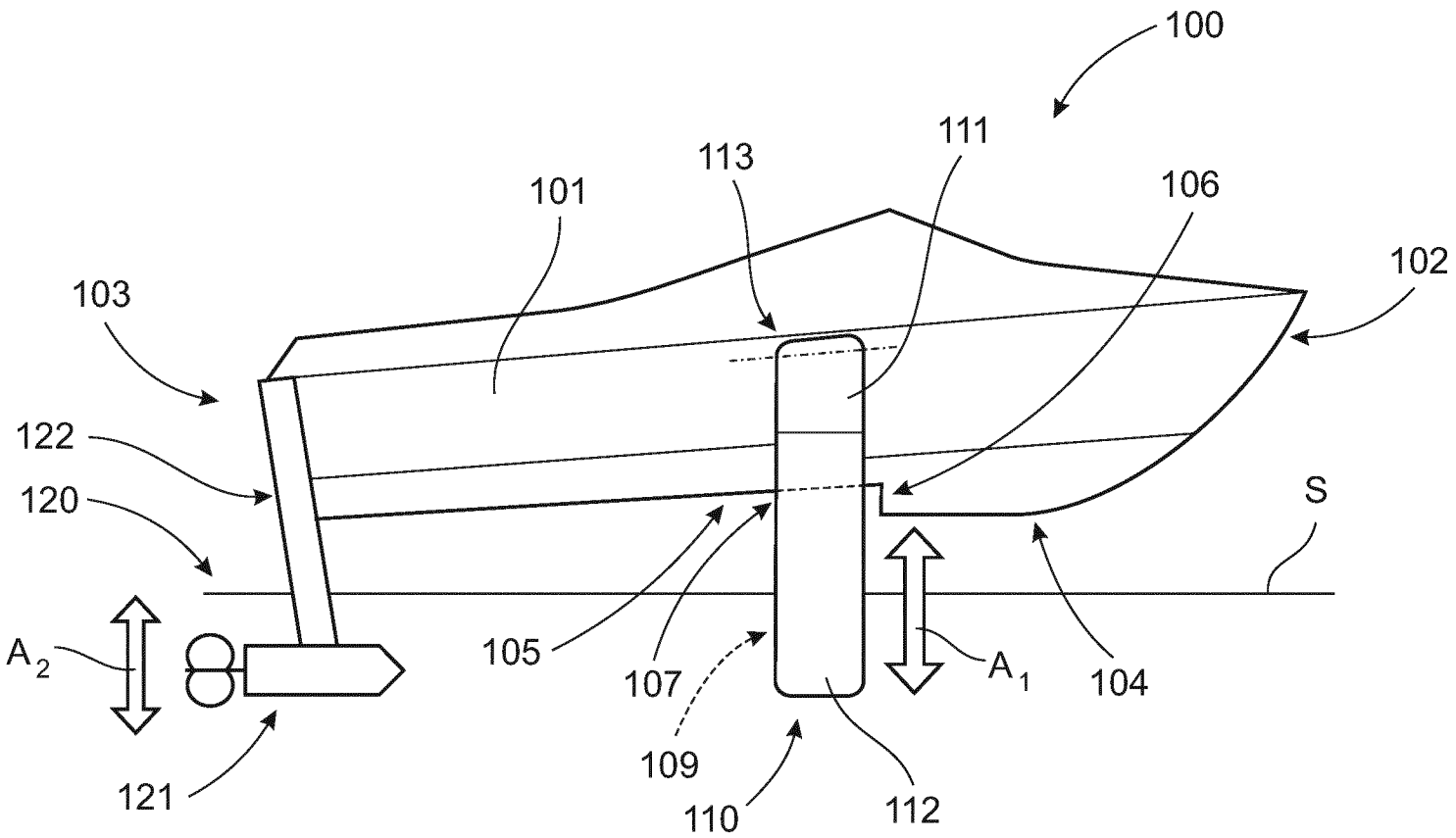
FIG. 1 shows a side view of a schematically illustrated vessel comprising a hydrofoil system according to the invention.

FIG. 1 shows a side view of a schematically illustrated marine vessel 100 comprising a hull 101 provided with a hydrofoil system according to the invention. The hydrofoil system in this example comprises a pair of foldable hydrofoils 109, 110 which are pivoted relative to the marine vessel. In this figure only a first hydrofoil 110 is visible, while a second hydrofoil 109 (arrow in dashed lines) is located on the opposite side of the hull 101. Each hydrofoil 109, 110 is controllable by at least one actuator (see FIG. 9, "930") for displacement of the foldable hydrofoils 109, 110 in a lateral direction of the marine vessel between a stowed position and a deployed position, as indicated by the arrow A1. FIG. 1 shows the hydrofoils 109, 110 in the deployed position, with the hull lifted out of the water 120. Each foldable hydrofoil comprises a first portion 111 comprising an upper end mounted by a hinge 113 relative to the hull above the water line on opposite sides of the marine vessel. In this example, the hinge 113 is pivoted about an axis parallel to the longitudinal axis of the vessel. Each first portion 111 extends adjacent the hull between the upper end and the water line of the marine vessel when the hydrofoil is in the stowed position (see FIG. 3A). Each foldable hydrofoil 109, 110 further comprise a second portion 112 comprising a free second end extending under the hull. The second portion 112 is submerged and arranged in a lateral recess 107 behind a stepped hull portion 106 of the marine vessel when the hydrofoil is in the stowed position. As shown in FIG. 1, the hull 101 comprises a bow section 104 extending rearwards from the bow 102 to the stepped hull portion 106 and a stern section 105 extending rearwards from the stepped hull portion 106 to the stern 103. FIG. 1 further shows a schematically indicated drive unit 121 connected to the stern 103 by an actuating means 122 that can adjust the position of the drive unit 121 in the vertical direction, as shown by arrow A2. The drive unit 121 is adjusted vertically together with the hydrofoils 109, 110 in order to maintain it submerged.

Figure 2:
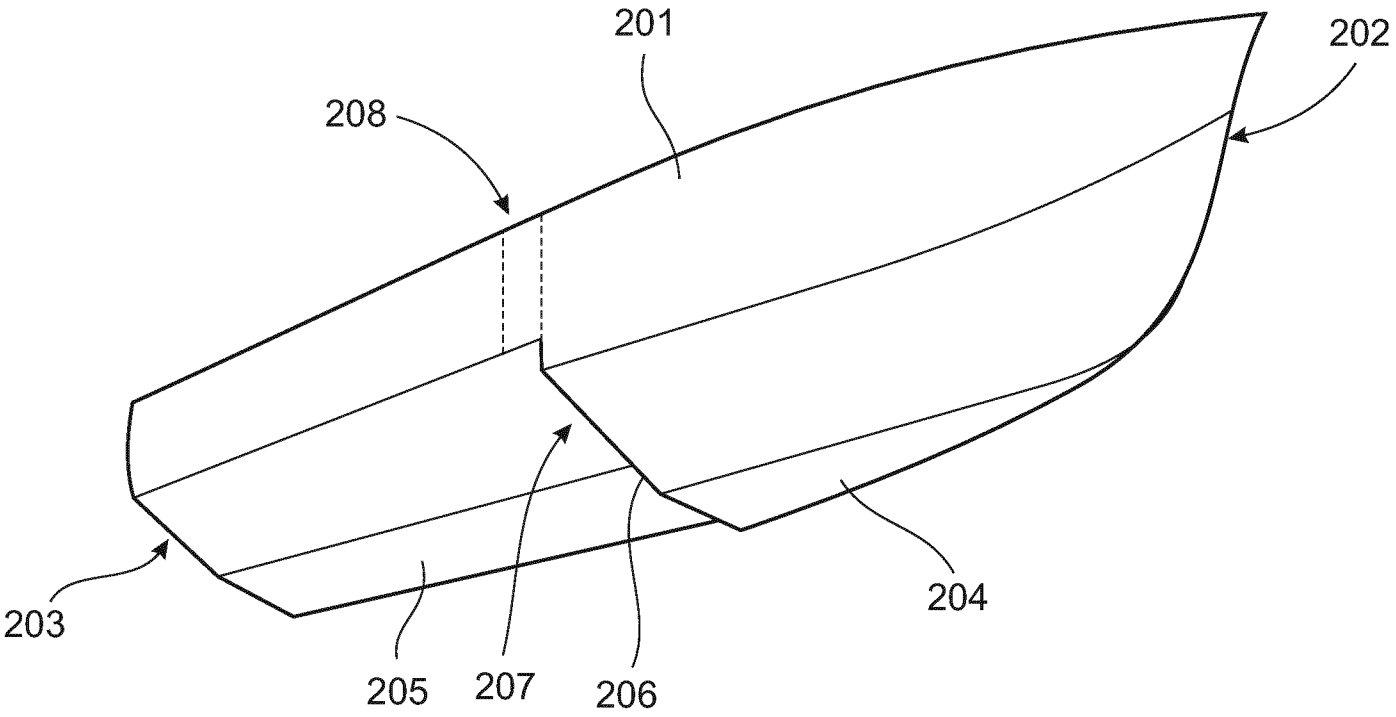
FIG. 2 shows a schematically illustrated vessel with a stepped hull.

FIG. 2 shows a schematically illustrated vessel with a stepped hull. FIG. 2 shows a hull 201 comprising a bow section 204 extending rearwards from the bow 202 to a stepped hull portion 206 and a stern section 205 extending rearwards from the stepped hull portion 206 to the stern 203. The stepped hull portion 206 is a break or lateral recess 207 in the hull 204 intended to reduce the wetted surface of the hull. Such steps can run straight across the hull (as shown in FIG. 2) or can be V-shaped, with the vertex facing forward or rearward. FIG. 2 further shows an optional recess 208 in the side of the hull 104. This recess 208 extending above the water line and can be provided to accommodate the first portion of a hydrofoil (not shown) in order to further reduce drag.

Figure 3A:
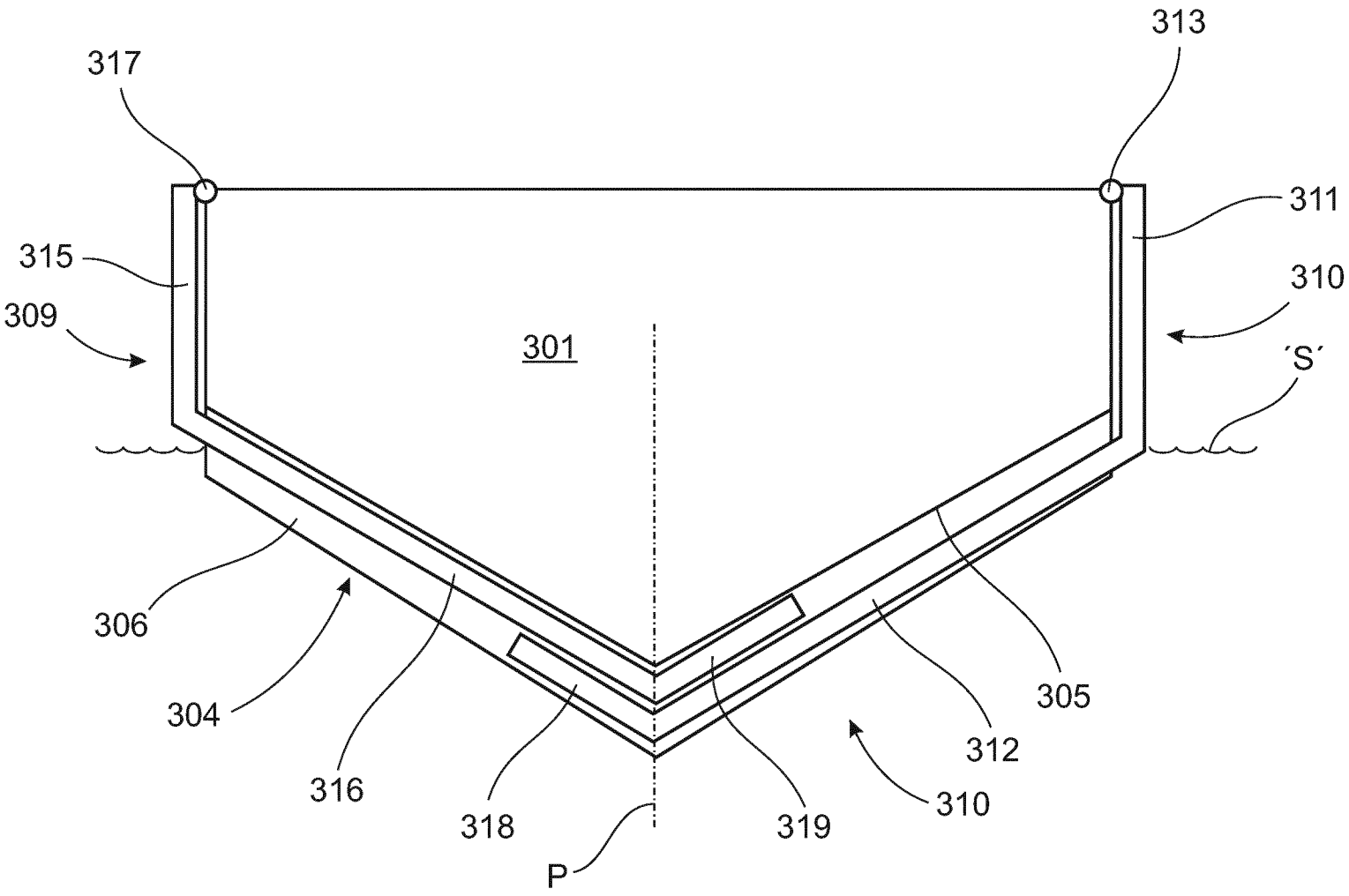
FIG. 3A-C show a schematic illustration of a hydrofoil system according to the invention and how it is deployed.
Figure 3B:
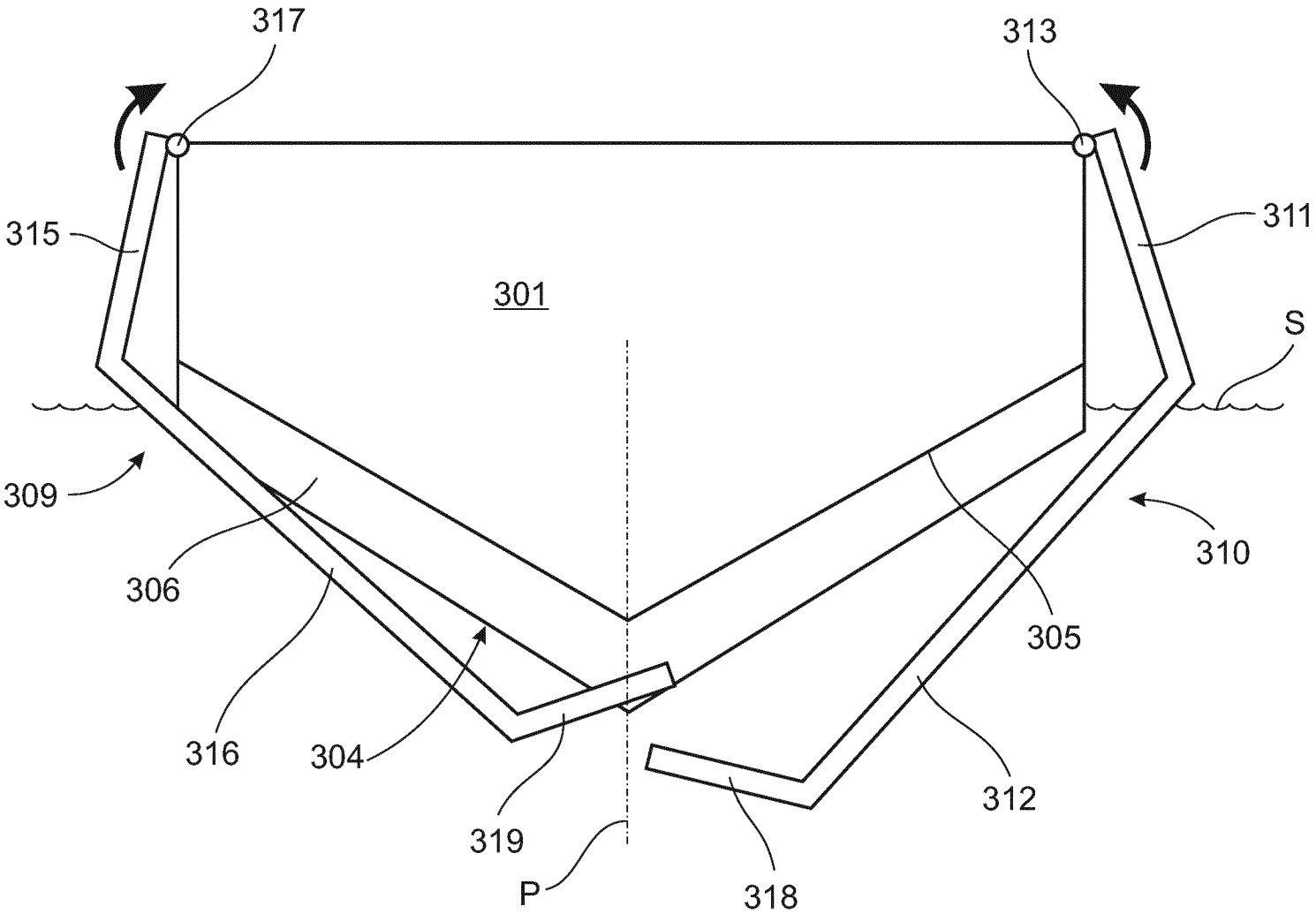
Figure 3C:
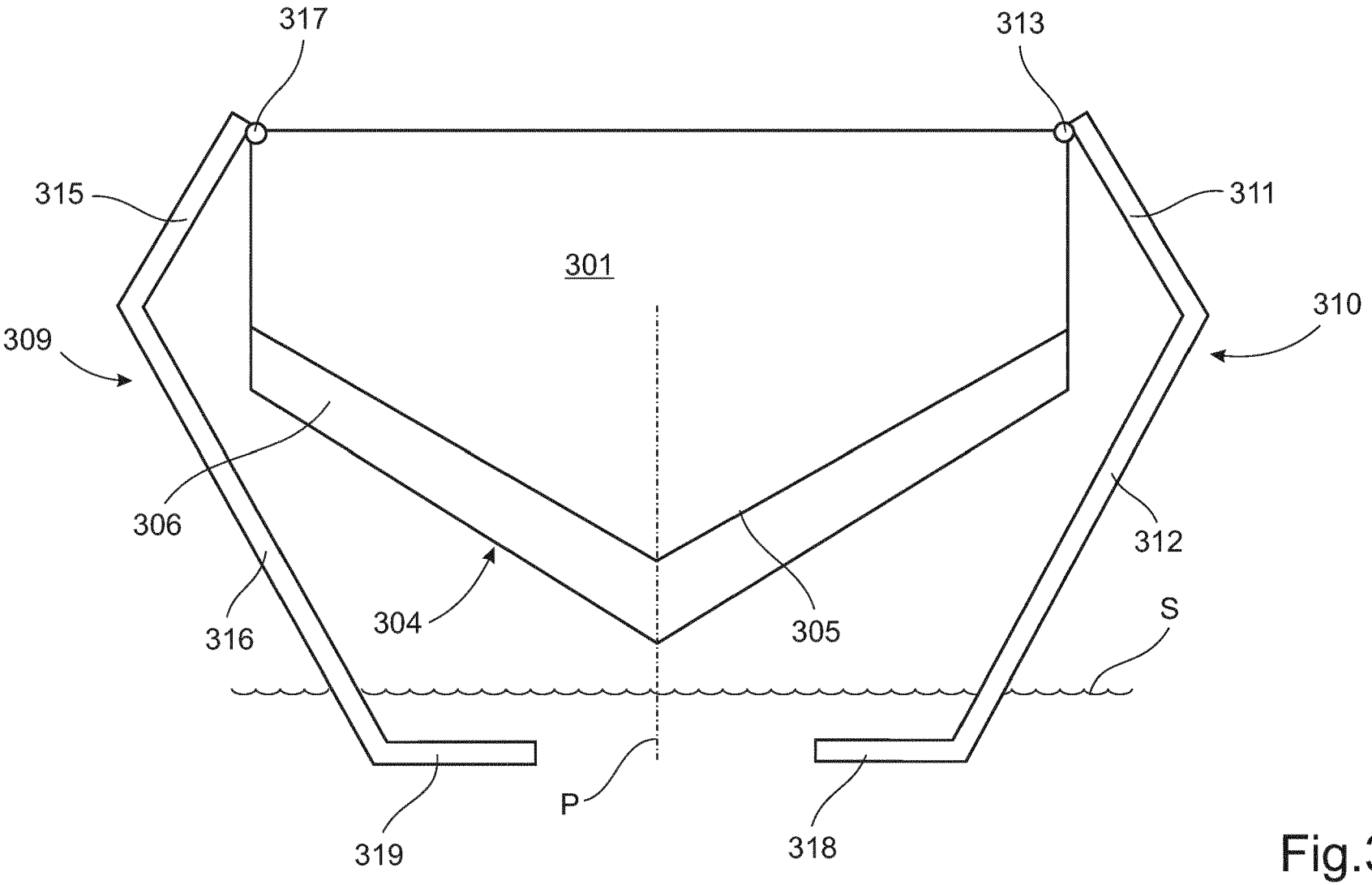

FIG. 3A-C show a schematic illustration of a hydrofoil system according to the invention and how it is deployed. FIG. 3A shows a cross-sectional rear view through the hull 301 and a pair of hydrofoils 309, 310 located in their stowed positions. Each foldable hydrofoil comprises a first portion 311, 315 comprising an upper end mounted by a hinge 313, 317 relative to the hull 301 above the water line on opposite sides of the marine vessel. Each first portion 311, 315 extends adjacent the hull between the upper end and the water line of the marine vessel. Each foldable hydrofoil 309, 310 further comprise a second portion 312, 316 comprising a free second end 318, 319 extending under the hull past the central longitudinal axis P. The second portions 312, 316 are submerged and arranged in a lateral recess behind a stepped hull portion 306 separating a bow section 304 and a stern section 305 of the hull 301 of the marine vessel. As indicated in FIG. 3A, both hydrofoils 309, 310 are located inside the outer envelope, or rearward extension, of the bow section 304 of the hull. In this way, the hydrofoils avoids causing an increased drag in the water flowing past the bow section 304 and the stepped hull portion 306 when travelling at relatively low speeds.

FIG. 3B shows an initial stage of the deployment of the foldable hydrofoils 309, 310. During deployment, an actuator (not shown) causes the hydrofoils to be rotated about their respective hinges 313, 317, as indicated by arrows in FIG. 3B. As shown in this example, the outermost hydrofoil 310 is deployed first, followed by the innermost hydrofoil 309.

FIG. 3C shows the foldable hydrofoils 309, 310 in their fully deployed, operational positions, when the vessel is travelling a speed sufficient for creating a lifting force that lifts the entire hull 301 above the surface of the water S. In the deployed position, the vessel is mainly supported by the submerged parts of the second portions 318, 319 of the hydrofoils 309, 310. The stern of the vessel will be supported by an additional lifting force provided by the drive unit (not shown), which can comprise separate hydrofoil surfaces.

Figure 4:
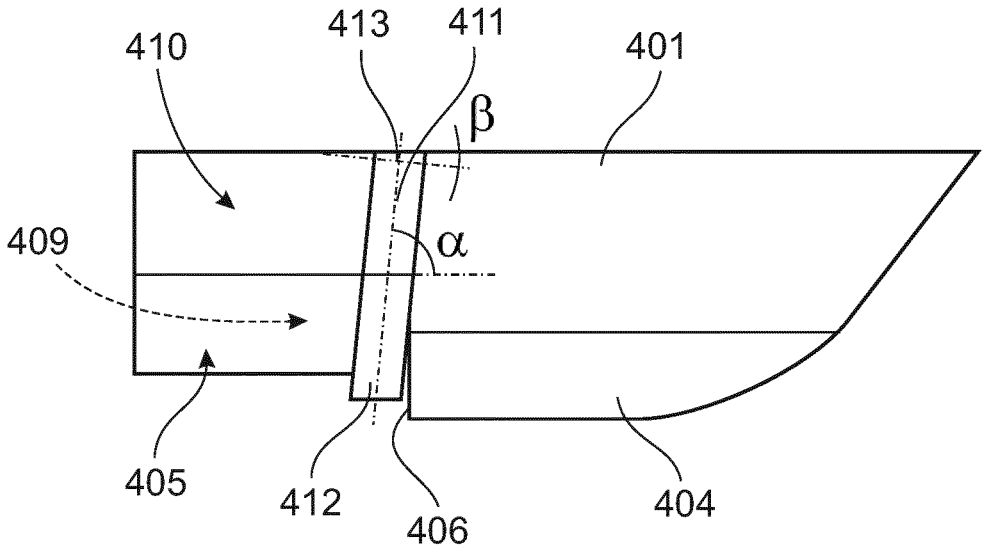
FIG. 4 shows a schematic side view of a first example of the hydrofoil system.

FIG. 4 shows a schematic side view of a first example of the hydrofoil system. FIG. 4 shows a hull 401 comprising a stepped hull portion 406 separating a bow section 404 and a stern section 405 of the hull 401 of the marine vessel. The figure shows one hydrofoil 410 comprising an upper, first portion 411 and a lower, second portion 412. An identical hydrofoil is mounted on the opposite side of the hull 401. In this example, the hydrofoil 410 is in its stowed position and is mounted by a hinge 413 placed at an angle β relative to the horizontal plane. The angle of at least the first portion 411 of the hydrofoil 410 can be selected independently of the angle of the hinge 413. However, in FIG. 4 the first portion 411 extends at right angles to the axis of the angled hinge 413, corresponding to an angle α relative to the water line, where $\alpha=90°-\beta$. Within the scope of the invention, the angle of the first portion of the hydrofoil can be selected to conform to the cross-sectional shape of stepped hull portion, above and/or below the water line. Hence, the angle of the first portion of the hydrofoil can be selected independently of the angle of the hinge supporting each hydrofoil. This arrangement will require a corresponding angle β between the first and second portions 411, 412 of the hydrofoil with the angled hinge, in order to place its submerged second portion in a substantially horizontal position for generating a sufficient lifting force.

Figure 5:
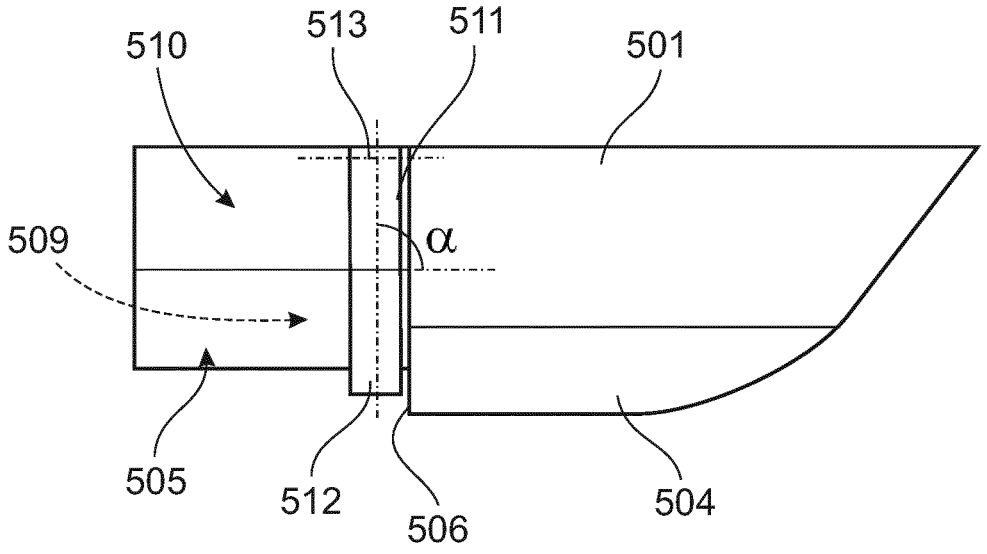
FIG. 5 shows a schematic side view of a second example of the hydrofoil system.

FIG. 5 shows a schematic side view of a second example of the hydrofoil system. FIG. 5 shows a hull 501 comprising a stepped hull portion 506 separating a bow section 504 and a stern section 505 of the hull 501 of the marine vessel. The figure shows one hydrofoil 510 comprising an upper, first portion 511 and a lower, second portion 512. An identical hydrofoil is mounted on the opposite side of the hull 501. In this example, the hydrofoil 510 is in its stowed position and is mounted by a hinge 513 placed in the horizontal plane, corresponding to an angle β of 0° compared to FIG. 4. Further, the first portion 511 extends at right angles to the axis of the horizontal hinge 513, corresponding to an angle α at right angles to the water line.

Figure 7:
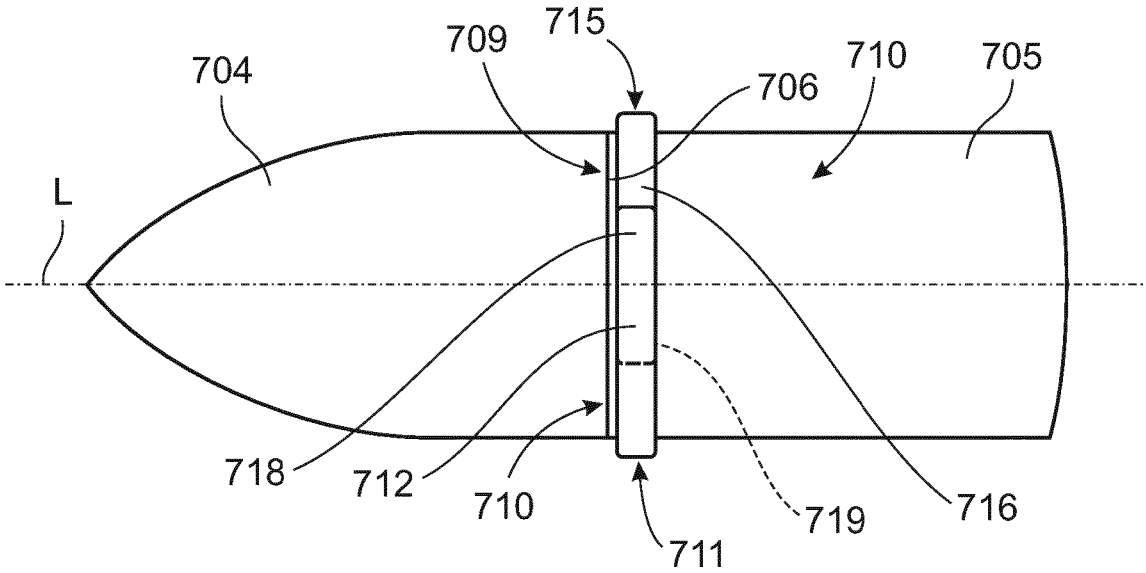
FIG. 7 shows a schematic lower view of the hydrofoil system in FIGS. 4 and 5.

FIG. 7 shows a schematic lower view of the hydrofoil system in FIG. 5. FIG. 7 shows a hull comprising a stepped hull portion 706 separating a bow section 704 and a stern section 705 of the hull of the marine vessel. The hydrofoil system comprises a first hydrofoil 710 having a first portion 711 and a second portion 712 and a second hydrofoil 709 having a first portion 715 and a second portion 716. The second portions 712, 716 have free end portions 718, 719 extending past the longitudinal axis L of the vessel in an overlapping relationship. According to this example, the first portions 711, 715 of the overlapping first and second hydrofoils 710, 709 comprise a hinges (FIG. 5; "513") having pivot axes extending in the horizontal plane in the longitudinal direction of the marine vessel.

During deployment, the overlapping hydrofoils 710, 709 are arranged to be displaced sequentially when moved towards their operative positions, wherein the outermost, first hydrofoil 710 is actuated first (see FIG. 3B) followed by the innermost hydrofoil 709. During retraction of the hydrofoils towards the stowed position the hydrofoils are actuated in reverse, wherein the innermost hydrofoil 709 is actuated first.

Figure 6:
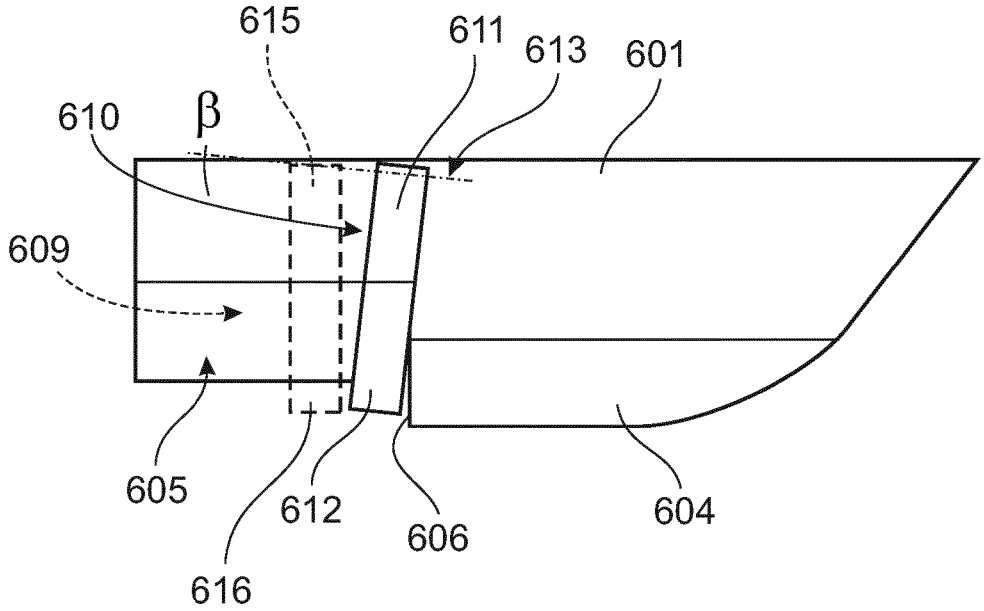
FIG. 6 shows a schematic side view of a third example of the hydrofoil system.

FIG. 6 shows a schematic side view of a third example of the hydrofoil system. FIG. 6 shows a hull 601 comprising a stepped hull portion 606 separating a bow section 604 and a stern section 605 of the hull 601 of the marine vessel. The figure shows a first hydrofoil 610 comprising an upper, first portion 611 and a lower, second portion 612. In this example, the first hydrofoil 610 is in its stowed position and is mounted by a hinge 613 placed at an angle β relative to the horizontal plane. The figure further shows second hydrofoil 609 comprising an upper, first portion 615 and a lower, second portion 616. In this example, the hydrofoil 610 is in its stowed position and is mounted by a hinge 613 placed in the horizontal plane.

Figure 8:
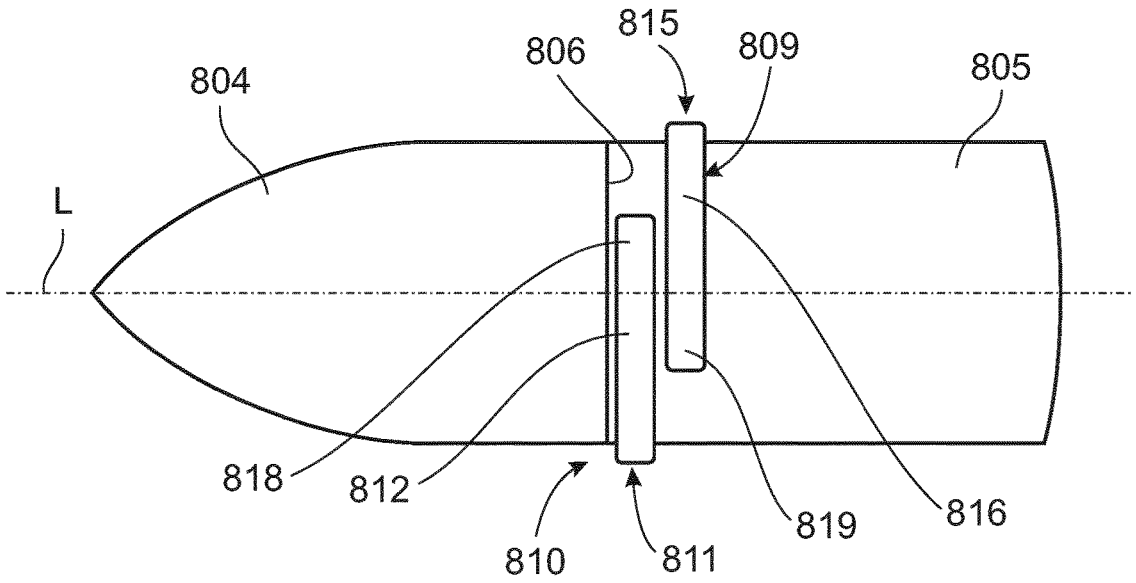
FIG. 8 shows a schematic lower view of the hydrofoil system in FIG. 6.

The arrangement shown in FIG. 6 can be used for the example in FIG. 8, which shows a schematic lower view of the underside of the hydrofoil system in FIG. 6. FIG. 8 shows a hull comprising a stepped hull portion 806 separating a bow section 804 and a stern section 805 of the hull of the marine vessel. The hydrofoil system comprises a first hydrofoil 810 having a first portion 811 and a second portion 812 and a second hydrofoil 809 having a first portion 815 and a second portion 816. The second portions 812, 816 have free end portions 818, 819 extending past the longitudinal axis L of the vessel in a side-by-side relationship. According to this example, the first portion 811 of the first hydrofoil 810 in the side-by-side arrangement comprises a hinge (FIG. 6; "613") having a pivot axis extending at an angle to the horizontal plane in the longitudinal direction of the marine vessel. However, the first portion 815 of the second hydrofoil 809 comprises a hinge (see FIG. 5) having a pivot axis extending in the horizontal plane in the longitudinal direction of the marine vessel.

When the hydrofoils are deployed, the side-by-side offset between the submerged second ends 818, 819 of each hydrofoil 810, 809 in the longitudinal direction of the vessel can be reduced or eliminated when each hydrofoil reaches its operative position. This effect is achieved by the angled hinge, which causes the second portion 812 of the first hydrofoil 810 to be displaced rearwards relative its stowed longitudinal position. Consequently, the generated moment requiring a steering correction in order to maintain the vessel on a straight heading can be reduced or eliminated. This arrangement will require a corresponding angle between the first and second portions of the hydrofoil with the angled hinge, in order to place its submerged second portion in a substantially horizontal position for generating a sufficient lifting force.

Alternative solutions can include angling the hinge of the second hydrofoil in the opposite direction, or to provide means for longitudinal displacement for one or both hydrofoils.

Figure 9:
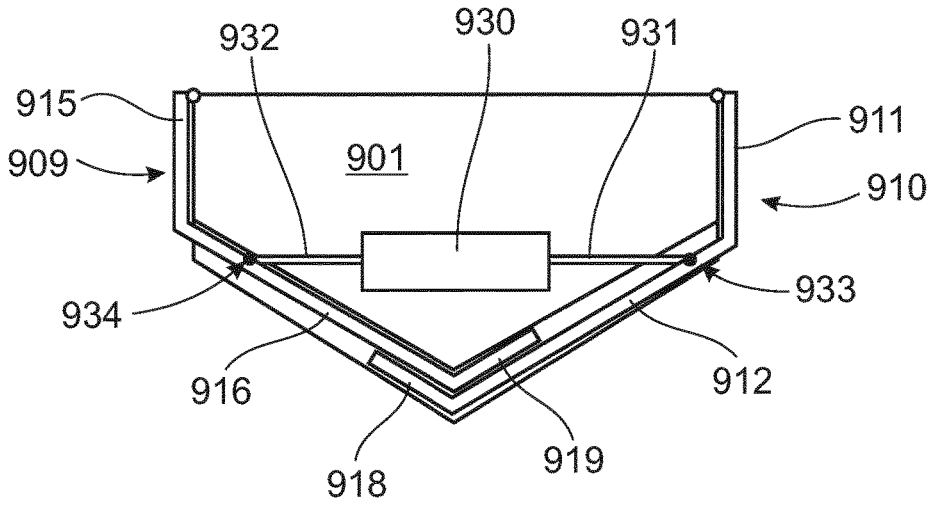
FIG. 9 shows a schematic illustration of an actuator for controlling a hydrofoil system according to the invention.

FIG. 9 shows a schematic illustration of an actuator for controlling a hydrofoil system according to the invention. FIG. 9 shows a cross-sectional rear view through the hull 901 and a pair of hydrofoils 909, 910 located in their stowed positions. Each foldable hydrofoil comprises a first portion 911, 915 comprising an upper end mounted by a hinge (see FIG. 3A) relative to the hull 901 above the water line on opposite sides of the marine vessel. Each first portion 911, 915 extends adjacent the hull between the upper end and the water line of the marine vessel. Each foldable hydrofoil 909, 910 further comprises a second portion 912, 916 comprising a free second end 918, 919 extending under the hull past its central longitudinal axis. The second portions 912, 916 are submerged and arranged in a lateral recess behind a stepped hull portion in the hull 301 of the marine vessel. The hydrofoils 909, 910 are connected to an actuator 930 arranged within the hull 901 of the marine vessel, which actuator are arranged to displace the hydrofoils between their stowed and deployed positions (see FIG. 3C).

FIG. 9 shows a single, common actuator for displacement of the hydrofoils. However, each hydrofoil can be connected to at least one actuator arranged within the hull of the marine vessel, which actuator is arranged to displace the hydrofoils between their stowed and fully deployed positions. The size and number of actuators is dependent on the force required to deploy and maintain the hydrofoils in their operative positions. Consequently, the hydrofoils can be operated by a single, common actuator, or by one or more actuators for each hydrofoil. According to one example, the at least one actuator is arranged below the water line within the hull of the marine vessel. The at least one actuator is preferably arranged below the water line within the hull of the marine vessel.

It is to be understood that the present invention is not limited to the embodiments described above and illustrated in the drawings; rather, the skilled person will recognize that many changes and modifications may be made within the scope of the appended claims. For instance, vessels may comprise fixed hydrofoils or hydrofoils with control surfaces as indicated in the background. Although no such features are described in the above examples, the invention is applicable to both types of hydrofoils.

The invention claimed is:

1. A hydrofoil system for a marine vessel comprising a hull, the hydrofoil system comprising at least one pair of foldable hydrofoils which are pivoted relative to the marine vessel, wherein each hydrofoil is controllable by at least one actuator for displacement of the at least one pair of foldable hydrofoils in a lateral direction of the marine vessel between a stowed position and a deployed position, characterized in that each foldable hydrofoil comprises a first portion comprising an upper end mounted hinged relative to the hull above the water line on opposite sides of the marine vessel;

wherein each first portion extends adjacent the hull between the upper end and the water line of the marine vessel when the hydrofoil is in the stowed position; and each foldable hydrofoil comprises a second portion comprising a free second end extending under the hull;

wherein the second portion is submerged and arranged in a lateral recess behind a stepped hull portion of the marine vessel when the hydrofoil is in the stowed position.

2. A hydrofoil system according to claim 1, characterized in that at least the submerged portions of the hydrofoils are located in the lateral recess behind the stepped hull portion of the marine vessel when the hydrofoils are in the stowed position.

3. A hydrofoil system according to claim 1, characterized in that a lower outer surface of each hydrofoil is at least flush with the submerged outer surface of the hull in front of the stepped hull portion when the hydrofoils are in the stowed position.

4. A hydrofoil system according to claim 1, characterized in that an outer side surface of each hydrofoil is located in a recess in the side of the hull above the water line when the hydrofoil is in the stowed position.

5. A hydrofoil system according to claim 1, characterized in that each hydrofoil comprises a single structural component having a shape conforming with the outer surface of the hull above and below the water line.

6. A hydrofoil system according to claim 1, characterized in that the first end of each foldable hydrofoil comprises a hinge having parallel pivot axes extending in the longitudinal direction of the marine vessel.

7. A hydrofoil system according to claim 1, characterized in that the second end of each hydrofoil extends at least up to the central longitudinal axis of the marine vessel.

8. A hydrofoil system according to claim 7, characterized in that that the second ends of each pair of hydrofoils are arranged to extend a predetermined distance past the central longitudinal axis of the marine vessel.

9. A hydrofoil system according to claim 8, characterized in that the second ends of each pair of hydrofoils are arranged to overlap when the hydrofoils are in the stowed position.

10. A hydrofoil system according to claim 9, characterized in that the overlapping hydrofoils are arranged to be displaced sequentially when moved towards the deployed position.

11. A hydrofoil system according to claim 8, characterized in that the second ends of each pair of hydrofoils are arranged to extend side-by-side adjacent the hull when the hydrofoils are in the stowed position.

12. A hydrofoil system according to claim 11, characterized in that the first end of one of the foldable hydrofoils comprises a hinge having a pivot axis extending at an angle to the horizontal plane in the longitudinal direction of the marine vessel.

13. A hydrofoil system according to claim 1, characterized in that each first portion extends downwards at right angles to the water line when the hydrofoil is in the stowed position.

14. A hydrofoil system according to claim 1, characterized in that each first portion extends downwards and rearwards at a predetermined angle to the water line when the hydrofoil is in the stowed position.

15. A hydrofoil system according to claim 1, characterized in that each hydrofoil is connected to at least one actuator arranged within the hull of the marine vessel, wherein the at least one actuator is arranged to displace the hydrofoils between their stowed and deployed positions.

16. A hydrofoil system according to claim 15, characterized in that the at least one actuator are arranged below the water line within the hull of the marine vessel.

17. Marine vessel characterized in that the marine vessel is provided with a hydrofoil system according to claim 1.

* * * * *